US009461419B2

(12) United States Patent
Hector, Jr.

(10) Patent No.: US 9,461,419 B2
(45) Date of Patent: Oct. 4, 2016

(54) CIRCUIT CONNECTOR WITH A LOW PROFILE PROTECTIVE OUTLET CONNECTOR ARRANGEMENT COVER DEVICE

(71) Applicant: Melvin G Hector, Jr., Tucson, AZ (US)

(72) Inventor: Melvin G Hector, Jr., Tucson, AZ (US)

(73) Assignee: Melvin G. Hector, Jr., Tucson, AZ (US)

( * ) Notice: Subject to any disclaimer, the term of this patent is extended or adjusted under 35 U.S.C. 154(b) by 8 days.

(21) Appl. No.: 14/169,910

(22) Filed: Jan. 31, 2014

(65) Prior Publication Data

US 2014/0213104 A1 Jul. 31, 2014

Related U.S. Application Data

(60) Provisional application No. 61/758,981, filed on Jan. 31, 2013.

(51) Int. Cl.
*H01R 13/648* (2006.01)
*H01R 24/30* (2011.01)
*H01R 25/00* (2006.01)

(52) U.S. Cl.
CPC ..... *H01R 24/30* (2013.01); *H01R 25/003* (2013.01)

(58) Field of Classification Search
CPC H01R 13/652; H01R 13/447; H01R 13/443; H02G 3/14
USPC ..... 439/106, 107, 135, 136, 142, 147–149, 439/652; 220/241, 242; 174/66, 67
See application file for complete search history.

(56) References Cited

U.S. PATENT DOCUMENTS

| | | | | |
|---|---|---|---|---|
| 5,004,435 | A * | 4/1991 | Jammet | 439/652 |
| 5,375,728 | A * | 12/1994 | West | 220/3.8 |
| 5,723,816 | A * | 3/1998 | Neece | 174/66 |
| 6,045,374 | A * | 4/2000 | Candeloro | 439/105 |
| 6,674,003 | B1 * | 1/2004 | Torres | 174/66 |
| 6,703,562 | B1 * | 3/2004 | Pacheco | 174/66 |
| 6,897,381 | B2 * | 5/2005 | He et al. | 174/67 |
| 6,977,342 | B1 * | 12/2005 | Maltby et al. | 174/66 |
| 7,271,338 | B1 * | 9/2007 | Rohmer | 174/66 |
| 7,381,894 | B1 * | 6/2008 | Shotey et al. | 174/66 |

* cited by examiner

*Primary Examiner* — Thanh Tam Le

(57) ABSTRACT

A new and useful electrical connector is provided, that is designed to protect existing electrical outlets from trauma and destruction, by preventing them from being dislodged by movement of a patient support such as a hospital bed, or scraped off of the wall by passing (moving) machinery, hospital beds, equipment and vehicles during the normal use of the bed, the machinery, or equipment. In this application reference to an electrical plug component encompasses traditional 2 or 3 prong plugs that pima into grounded or ungrounded wall outlet sockets, as well as phone or laptop jacks that would plug into wall outlet sockets configured for such jacks. In addition, a new and useful coupling structure, for electrical couplings that need to be spaced from a wall socket, is provided.

13 Claims, 8 Drawing Sheets

FIG. 6(A)
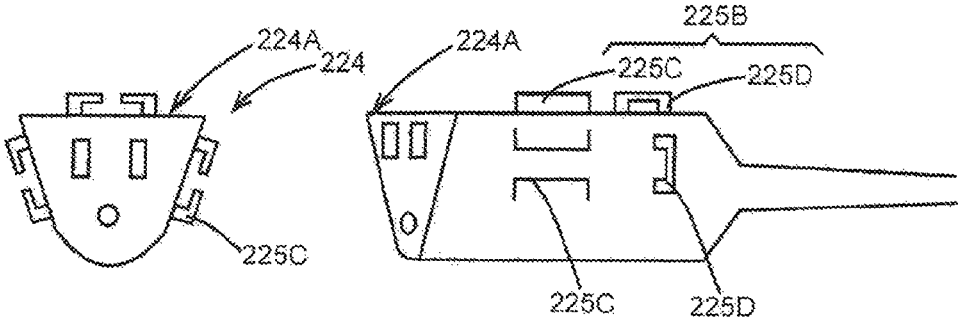
FIG. 6(B)
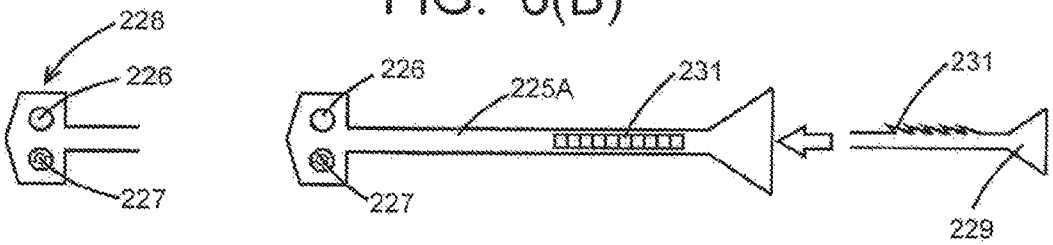
FIG. 6(C)
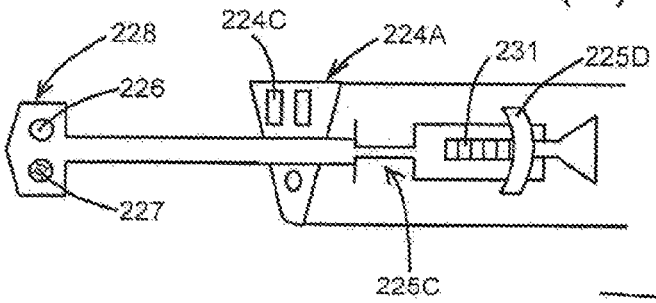
FIG. 6(D)
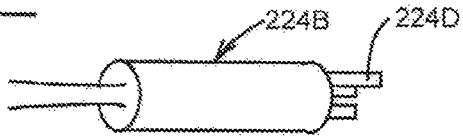
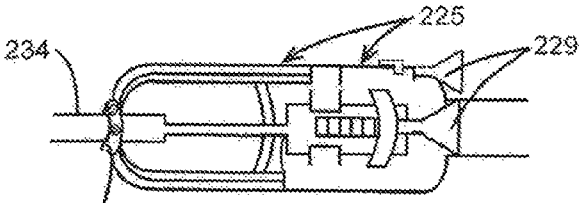
FIG. 6(E)
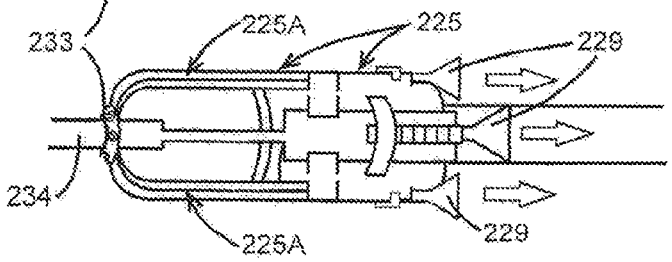
FIG. 6(F)

CIRCUIT CONNECTOR WITH A LOW PROFILE PROTECTIVE OUTLET CONNECTOR ARRANGEMENT COVER DEVICE

RELATED APPLICATION/CLAIM OF PRIORITY

This application is related to and claims priority of U.S. provisional application Ser. No. 61/758,981, filed Jan. 31, 2013, and which provisional application is incorporated lay reference herein.

BACKGROUND

The present invention relates to a new and useful electrical connector, that is particularly useful in a medical care facility such as a hospital or nursing home, where frequent movement of a hospital bed, and movement of machinery and/or equipment about the hospital bed, is common, and that movement can damage or dislodge existing electrical connectors from their wall sockets. The electrical circuit connector of the invention is also useful with devices that are in jeopardy of damage (such as phone jacks, laptop jacks, or equipment) that would be located in the vicinity of moving objects such as furniture or beds, and plugged into a wall outlet (socket) located near furniture items or beds.

The present invention also provides a new and useful electrical coupling structure, that provides an electrical coupling that extends away from the circuit connector and can be used to securely provide electrical connection between components that are thus purposefully extended away from the wall socket. The electrical coupling comprises first and second coupling parts, and structure for releasably securing the first and second coupling parts to each other. The first and second coupling parts have respective mating portions that are coupled together to provide an electrical connection between the coupling parts, and the structure for releasably securing the first and second coupling parts to each other comprises a device that is configured to urge the coupling parts together and to provide a releasable lock that holds the coupling parts together and is releasable to enable the coupling parts to be separated, to break the electrical connection between the coupling parts.

Each of the low profile circuit connector and the coupling structure of the present invention provides a new and useful way of protecting existing electrical outlets (or electrical couplings) from trauma and destruction by preventing them from being dislodged by movement of the hospital bed, or scraped off of the wall by passing (moving) machinery, hospital beds, furniture, equipment and vehicles during the normal use of the bed, furniture, the machinery, or equipment.

Electrical plug-ins have been used for decades to connect electrically powered devices to electrical outlets quite efficiently. With the advent of more modern equipment designed to function in tight spaces such as the new "low beds" in hospitals and nursing homes, the frequent result is that the bed by moving up and down as it is designed can easily scrape the electrical plug-ins of electrical equipment as it moves up and down against the wall—often the plug in of the bed itself—completely or partially off the wall, causing damage to the plug-ins, to the equipment that the plug-ins serve, and to the electrical outlets themselves and creating a fire hazard or increasing the personal risk of shock or injury to the electrician who is required to undo this damage and repair it. Frequent strategies of using screw attachments to "track" wires across the wall only increase the exposure and risk of damage to the wiring; tactics of moving the patient's bed away from the wall only increases the chance for injury for the patient when falling between the bed and the wall.

Many devices have been constructed to protect the electrical outlet from weather conditions, from children, from inappropriate use, from theft, but none have done so with the purpose or consideration of attempting to create a protective cover for outlets to prevent them from being literally scraped off the wall with subsequent attendant damage, costs, injuries.

SUMMARY OF THE INVENTION

One aspect of the present invention provides a new and used electrical circuit connector that is designed to protect existing electrical outlets (sockets) and electrical appliances plugged into them from trauma and destruction, by preventing them from being dislodged by movement of the hospital bed, or scraped off of the wall by passing (moving) machinery, hospital beds, equipment and vehicles during the normal use of the bed, the machinery, or equipment.

The present invention provides a new, inexpensive, convenient, and useful way to protect electrical outlets and the electrical plug-ins they are designed to serve from being torn off the walls by the use of other equipment, while continuing to provide the service of the electrical outlet in the vicinity of its intended locale. Specifically, the 'low profile protective outlet connector arrangement cover device'.

An electrical circuit connector, according to the present invention comprises a cap formed of non conducting material. The cap has a perimeter, and a first side configured to lie directly against a wall with the perimeter as close to the wall as possible when the cap is attached to a wall outlet. The first side has a receptacle that fits snuggly around one or more electrical circuit plug components configured to engage the sockets of a wall outlet and connect the connector to the wall outlet and electrical conductors extending from the electrical plug components and along the first side of the cap, and to the perimeter of the cap. The cap has a second side having a substantially smooth, continuous surface extending from the perimeter of the cap over the entire extent of the cap, that provides an insulating cover for the electrical plug components and a relatively smooth, continuous exterior surface for the cap when the electrical connector is attached to a wall outlet, as well as a router to direct the electrical cords from the circuit director to the perimeter of the cap; so that electrical conducting portions of the circuit connector are electrically insulated by the cap, extend along the first side of the cap to the perimeter of the cap, and the perimeter and relatively smooth, continuous surface of the cap provides an exterior of the cap that is relatively free of edges, ridges or other surface configurations that could be caught by an object rubbing against the cap that would cause the cap to pull away from the wall when the electrical circuit connector is connected to a wall socket.

According to a preferred embodiment, the cap has an electrically insulated transition router portion at its perimeter, that provides a route for the insulated electrical circuit connection between the electrical conductors that extend to the perimeter of the cap and electrical wires that extend beyond the perimeter of the cap to a coupling configured to mate with another connector for providing electrical connection to a device associated with the other connector. In addition, the relatively smooth, continuous surface has a curved configuration from the perimeter over the entire extent of the cap. More particularly, the relatively smooth, continuous surface of the cap has a curved partial spherical configuration with a curvature that has a relatively constant radius.

In this application reference to an electrical plug component encompasses traditional 2 or 3 prong plugs that plug into grounded or ungrounded wall outlet sockets, as well as phone or laptop jacks that would plug into wall outlet sockets configured for such jacks.

Another aspect of the present invention relates to a new and useful electrical coupling structure, which provides an electrical circuit coupling that extends away from the connector, and can be used to securely provide electrical connection between components that extend away from the wall socket. The electrical coupling structure (which can be used with the electrical connector or with other electrical connectors that plug into wall sockets) comprises first and second coupling parts, and structure for releasably securing the first and second coupling parts to each other. The first and second coupling parts have respective mating portions that are coupled together to provide an electrical connection between the coupling parts, and the structure for releasably securing the first and second coupling parts to each other comprises a device that is configured to urge the coupling parts together and to provide a releasable lock that holds the coupling parts together and is releasable to enable the coupling parts to be separated, to break the electrical connection between the coupling parts.

The new coupling structure of the invention is designed for the situation where the circuit connection is spaced from the wall socket and requires an electrical coupling that is secure, even though the connecting plug in may come in many sizes and shapes depending on the machine it serves.

Further features of the present invention will become apparent from the following detailed description and the accompanying drawings.

BRIEF DESCRIPTION OF THE DRAWINGS

FIG. 6 (parts A-F) is a schematic illustration of a new and useful electrical coupling structure, according to the present invention.

DETAILED DESCRIPTION

As discussed above, one aspect of the present invention relates to a new and useful electrical connector that is particularly useful with a patient support such as a hospital bed. That aspect of the present invention is described herein in connection with a patient support such as a hospital bed, and from that description, the Manner in which the invention can be applied to equipment such as phone jacks, laptop jacks, or other equipment that might have issues similar to those found with electrical connectors in the vicinity of hospital beds will be apparent to those in the art.

Figure 7:
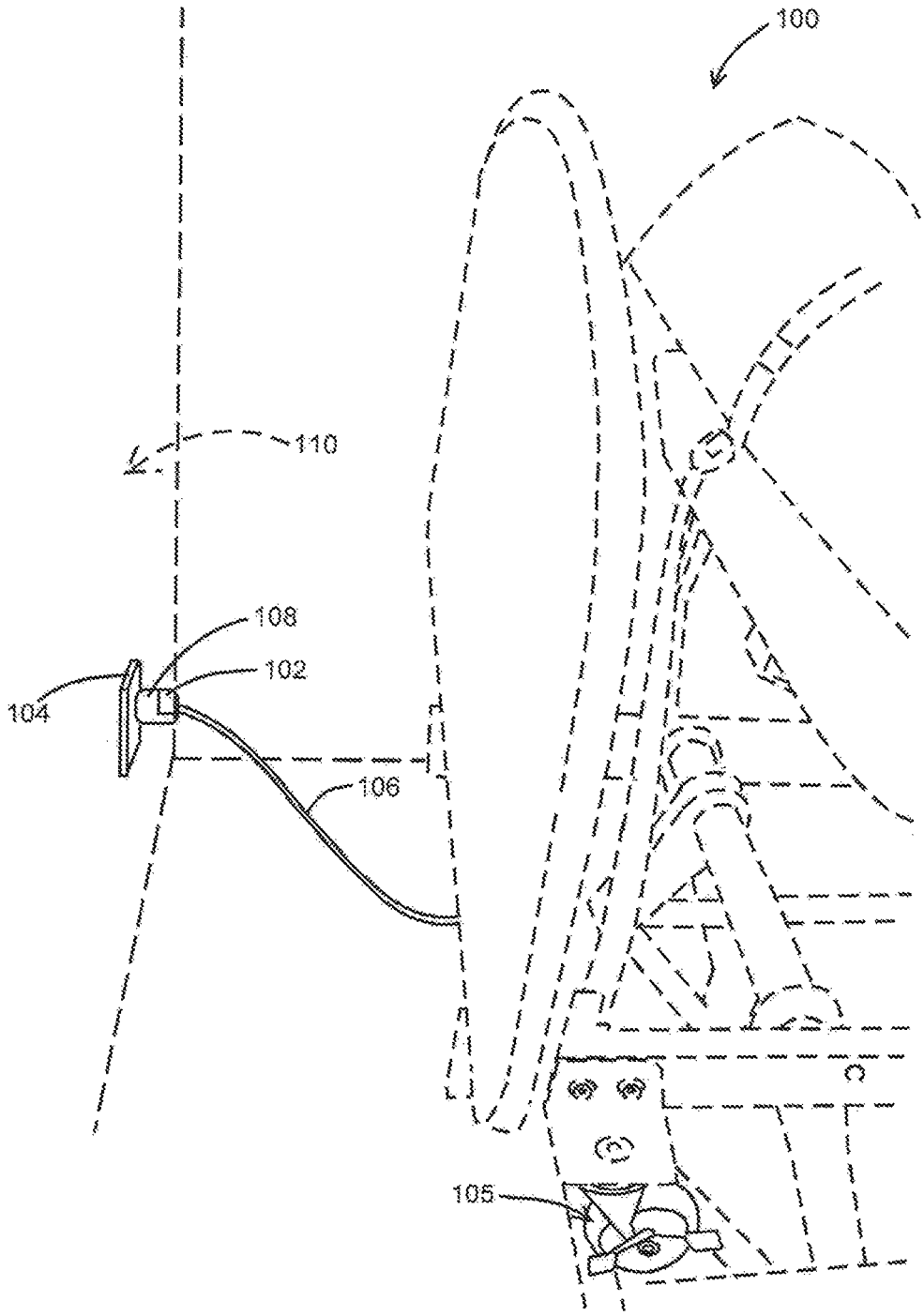
FIG. 7 is a schematic illustration of a portion of a hospital bed (shown in dashed lines) with a current type of connector.

FIG. 7 shows (in dashed lines) a portion of a traditional hospital bed 100, with a traditional electrical connector 102 of the type that is typically found with a hospital bed. The hospital bed 100 is on wheels/rollers 105 that enable the hospital bed to be maneuvered about a hospital room or hospital facility. The hospital bed can be raised and, lowered in ways well known to those in the art. The electrical connector 102 is at the end of an electrical cable 106, and has a plug 108 that is plugged into a wall socket 104. As the hospital bed is being maneuvered about a room, or raised or lowered, there is mechanical strain on the plug 108 that can cause trauma and destruction to the connector, e.g. by causing the plug to be scraped off of the wall 110 (and the wall socket 104) by passing machinery, movement of the hospital bed, use of tools and vehicles during the normal use of the hospital bed.

Figure 1A:
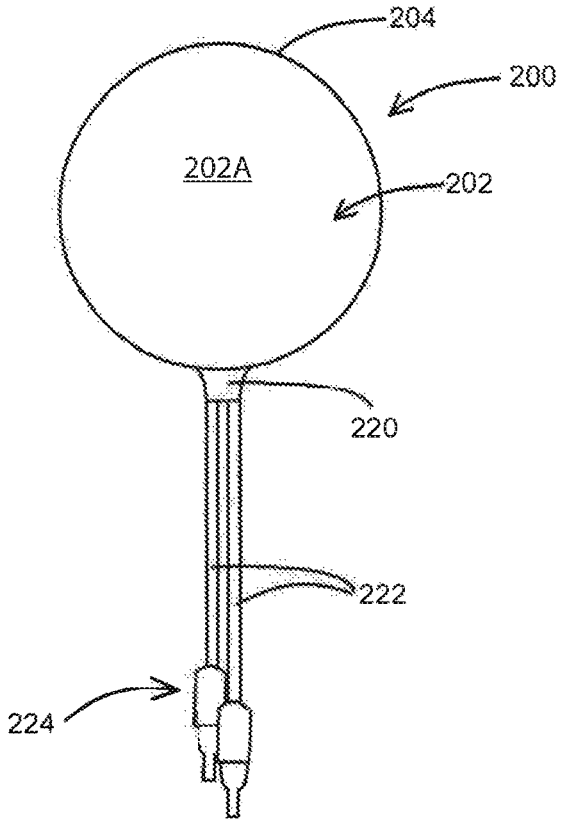
FIG. 1A is a schematic plan view of the second or outside of an electrical circuit connector assembly according to the present invention.
Figure 1B:
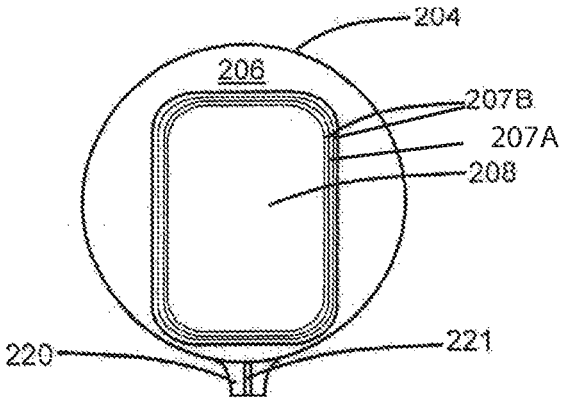
FIG. 1B is a schematic view of the first or inside of the cap device showing structure that covers the circuit connector structure of the assembly.
Figure 2A:
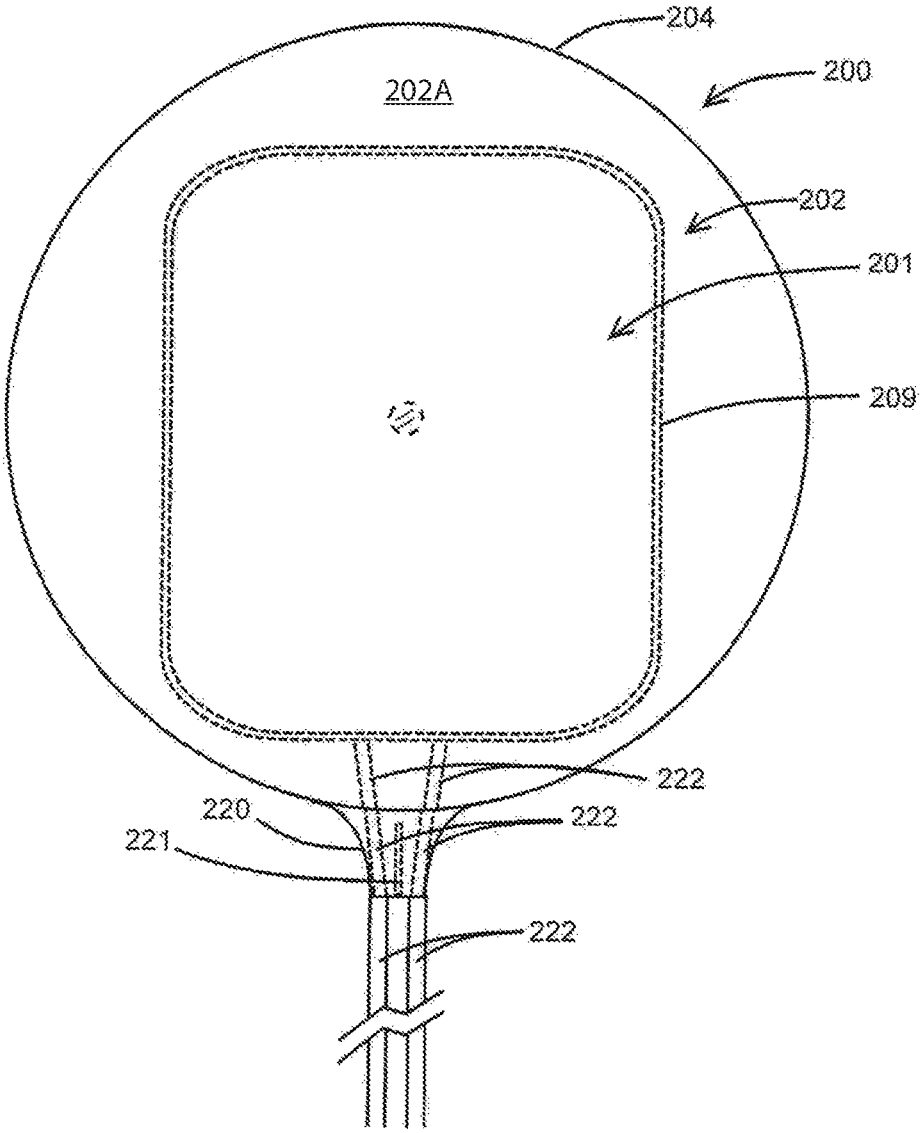
FIG. 2A is an enlarged view of the outside of the electrical connector of FIG. 1 revealing (in dashed lines) its relationship to the structure that covers the circuit connecter structure that fits within it.
Figure 2B:
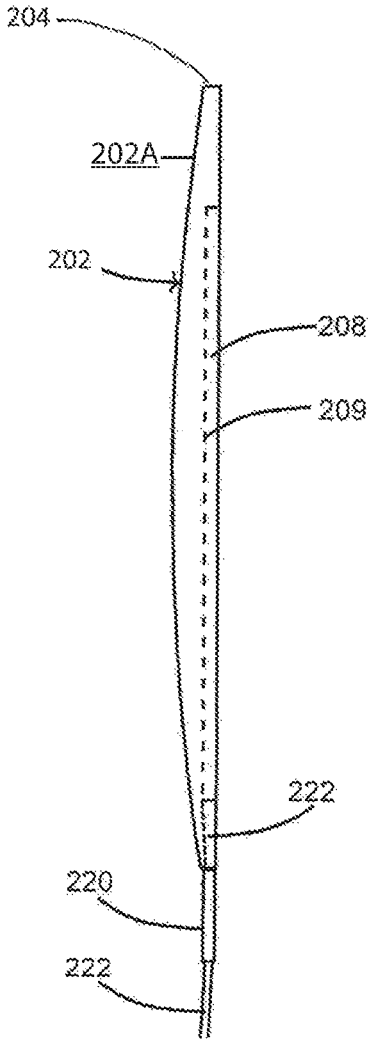
FIG. 2B is a schematic view of the side of the low profile circuit connector, with the cap covering the circuit connector assembly.

The present invention provides an electrical circuit connector assembly 200 shown in FIGS. 1A, B-5A, 5B that is designed to protect existing electrical outlets from trauma and destruction, by preventing them from being scraped off of the wall 110 by passing machinery, movement of hospital beds, use and operation of tools and vehicles during the normal use of the hospital bed.

Thus, the electrical connector aspect of the present invention provides a new, inexpensive, convenient, and useful way to protect electrical outlets and the electrical plug-ins they are designed to serve from being torn off the walls by the use of other equipment, while continuing to provide the service of the electrical outlet in the vicinity of us intended locale.

Figure 3:
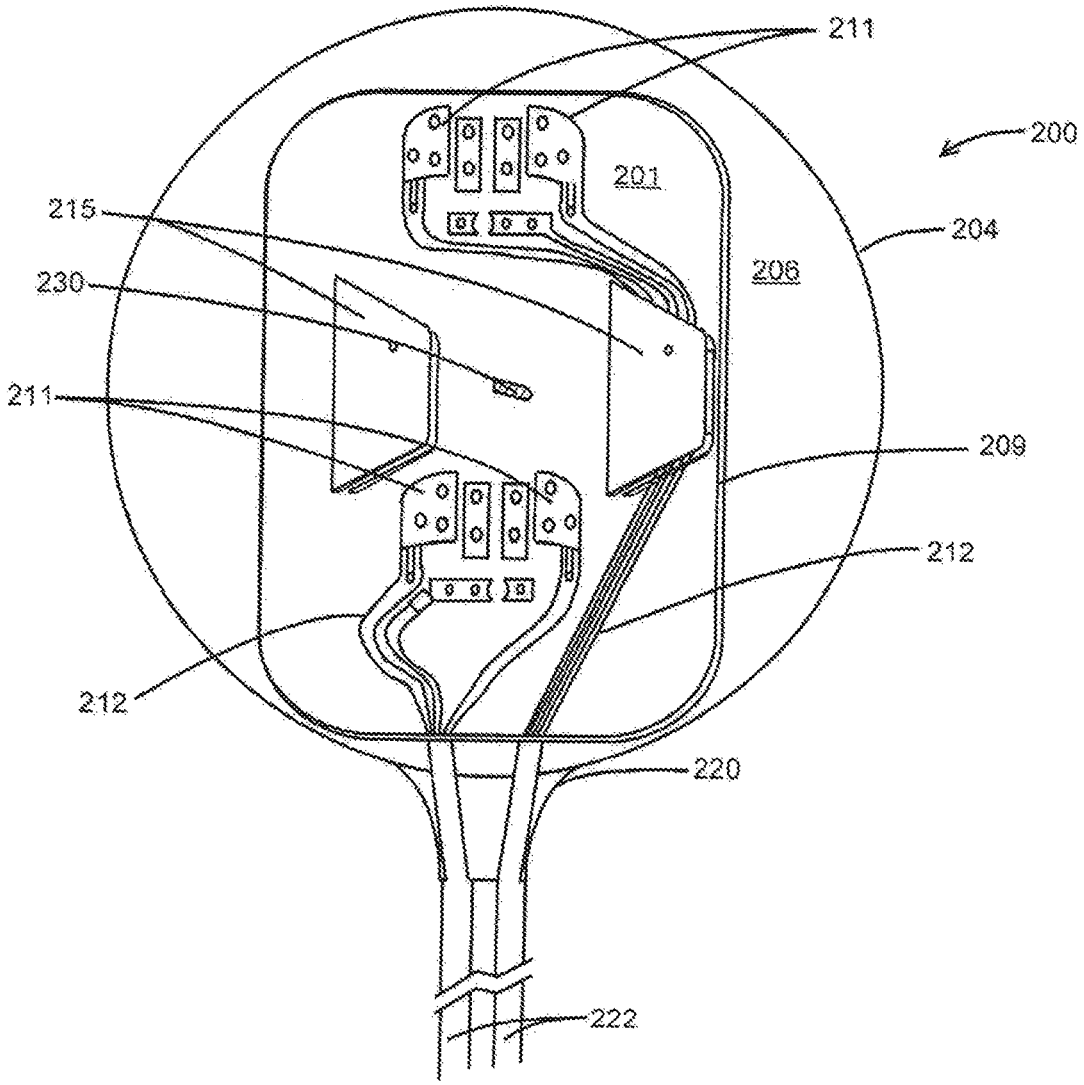
FIG. 3 is a schematic plan view of the inside of an electrical circuit connector assembly according to the present invention.
Figure 4:
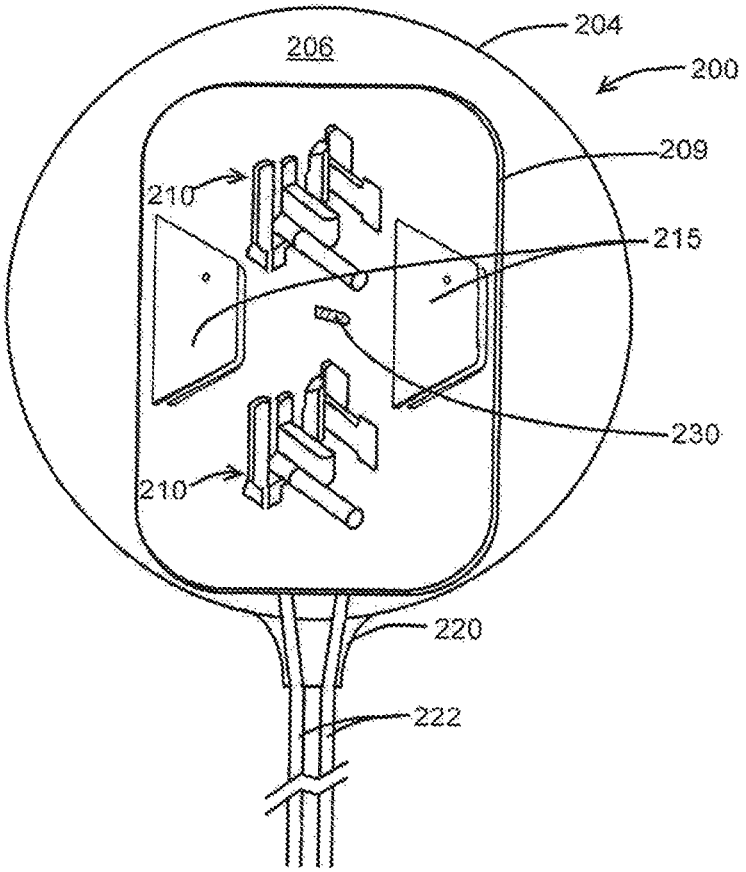
FIG. 4 is a schematic three dimensional view of the inside of an assembled electrical circuit connector assembly with its covering cap attached according to the present invention.
Figure 5A:
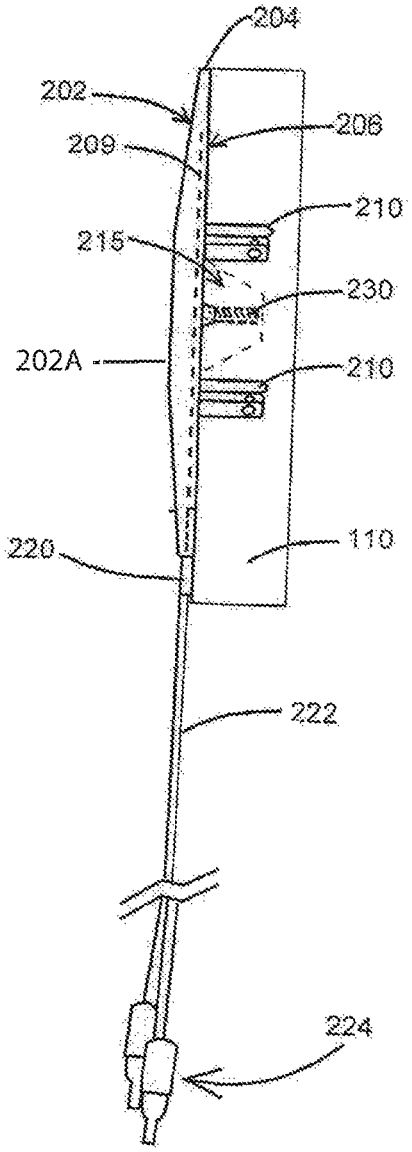
FIGS. 5A and 5B provide schematic illustrations of the side (FIG. 5A) and front (FIG. 5B) of an electrical connector assembly according to the present invention, showing the external couplings at the ends of the connector assembly.
Figure 5B:
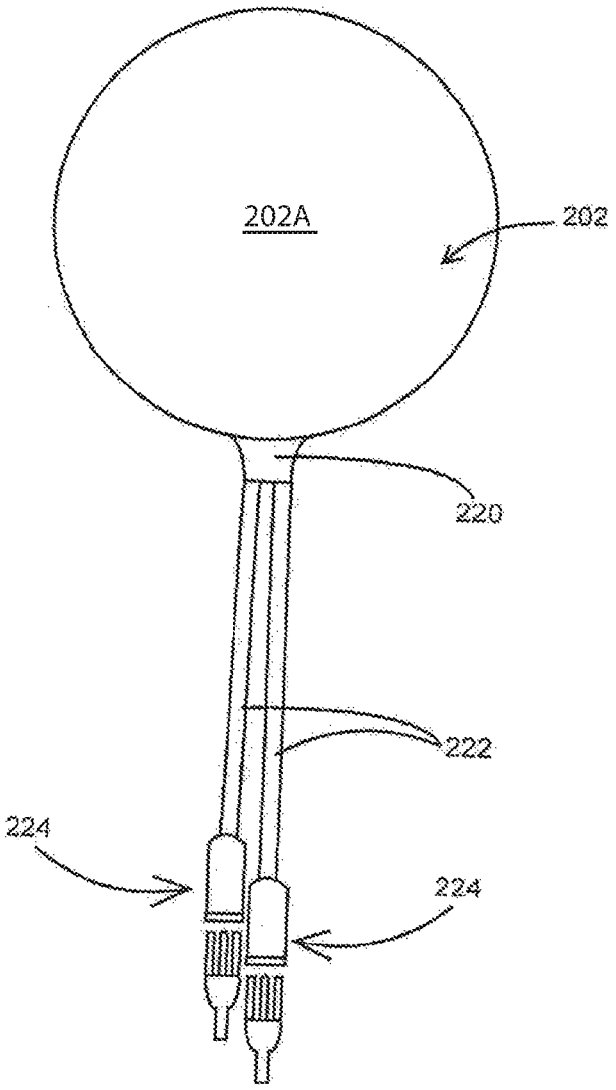

Referring to FIGS. 1A-1B through 5A, 5B, an electrical circuit connector assembly 200, according to the present invention comprises a cap 202 formed of non-conducting material (preferably a modestly flexible plastic material). The cap 202 has a perimeter 204, and a first side 206 (the "inside") configured to lie directly against a wall 110 (see FIG. 5A) with the perimeter 204 as close to the wall as possible when the cap is properly attached to the circuit connector that is in turn attached (plugged in) to a wall outlet and held by attaching screw 230. The first side 206 has a receptacle 208 within it that closely accepts the configuration of the circuit connector structure 201 and has ridged edges within 207B that will mesh with a single ridged edge 207A surrounding the circuit connector structure 201 and its electrical circuit plug components 210 and 211 (FIGS. 3 and 4) molded and configured within it to engage the sockets of a wall outlet (similar to wall socket 104 of FIG. 7) and connect the circuit connector structure 201 to the wall outlet, and the cap 202 in turn to it. The inside of the circuit connector assembly also has molded and configured conductive posts 211 (FIG. 3) physically and electrically connected to the plug components 210 (FIG. 4) and physically and electrically connected to electrical conductors 212 extending from the electrical plug components and eventually along the inside of the cap as connecting wire 222 and through the perimeter of the cap to coupling structure 224. In addition, the circuit connector structure 201 has stabilizing wings 215 that provide some additional rigidity to the circuit connector structure and provide lateral stability to it and the cap attached to it. The cap has an outside or second side 202*a* having a substantially smooth, continuous surface extending from the perimeter of the cap over the entire extent of the cap (FIGS. 1A, 1B, 2A, and 2B), that provides an insulating cover for the electrical circuit connector plug components 201 and a relatively smooth, continuous exterior surface for the cap when the electrical circuit connector is attached to a wall outlet and covered by the cap; so that electrical conducting portions 210, 211 and wires 212 of the circuit connector structure are molded within the inside of the circuit connector structure 201, ultimately couched within receptacle 208, and tightened against the wall by compression of the cap 202 onto the exposed surface of the circuit connector structure 201, thereby latching the single ridge of 207A within the ridges of 207B, and forming a latching mechanism 209 that holds the assembly tightly adjacent to the wall 110 within which the plug in resides. This feature provides an exterior of the cap that is relatively free of edges, ridges or other surface configurations that could be caught by an object rubbing against the cap that would cause the cap to pull away from the wall when the electrical connector is connected to a wall socket.

When the circuit connector structure 201 is plugged and fastened into a wall socket, a screw 230 can be tightened through it into the slot that is normally used to couple the wall socket cover to the wall 110 (FIG. 5A), so that the inside and perimeter of the circuit connector are held tightly against the wall. The ridges 207B of the cap receptacle 208 are snapped over the single ridge 207A of the circuit connector 201, pressing the transitional piece 220 to include and direct the insulated wires 222 using the partition 221 away from the circuit connector 201 and towards the coupling structure 224 that attaches independent electrical instruments to this assembly. The smooth continuous outer surface 202*a* of the cap 202 is then in place on the outside of this inner molded electrical configuration and is free of burrs, edges or other configurations on which a tool, a part of the hospital bed, a piece of machinery could catch, and thereby cause trauma to, or displacement of, the cap.

When the circuit connector structure 201 is plugged and fastened into a socket, a screw 230 can be tightened through it into the slot that is normally used to couple the wall socket cover to the wall socket 110 (FIG. 5A), so that the inside and perimeter of the circuit connector are held tightly against the wall. The ridges of the cap receptacle 208 are snapped over the single ridge 207A of the circuit connector 201, pressings the transitional piece 220 to include and direct the insulated wires 222 using the partition 221 away from the circuit connector 201 and towards the connector 224 that attaches independent electrical instruments to this assembly. The smooth continuous outer surface of the cap 202 is then in place on the outside of this inner molded electrical configuration and is free of burrs, edges or other configurations on which a tool, a part of the hospital bed, a piece of machinery could catch, and thereby cause trauma to the cap.

According to a preferred embodiment, the cap has an electrically insulated transition portion 220 at its perimeter, that provides an insulated electrical circuit pathway for the connection between the electrical conductors 222 that extend to the perimeter of the cap and continue as electrical wires 222 that extend beyond the perimeter of the cap to coupling structure 224 that provides electrical coupling at a location that is spaced at chosen distances from the electrical connector and the wall socket. The coupling structure 224 is the new and useful coupling structure aspect of the present invention, and is described in more detail below in connection with FIG. 6 (A-F). That coupling structure 224 is designed for the situation where the circuit connection is spaced from the wall socket and requires an electrical coupling that is secure, even though the connecting plug forming one of the coupling parts of the coupling structure may come in many sizes and shapes depending on the machine it serves.

With the connector structure described herein, the relatively smooth, continuous outer surface of the cap has a curved configuration from the perimeter over a large extent (and may extend over the entire extent) of the cap. More particularly, the relatively smooth, continuous surface of the cap can have a curved partial spherical configuration with a curvature that has a relatively constant radius (and if desirable, a small relatively flat portion in its center that mates with the curved portion in a relatively smooth transit ion).

The coupling structure 224 is shown in FIG. 6 (parts A-F). The coupling structure is designed to provide an electrical coupling that extends away from the connector (in the sense that it is located at the end of the electrical wires 222), and is designed to securely provide electrical connection between a coupling part 224A (FIG. 6A) and a mating coupling part 224B (FIG. 6D), where the mating coupling part 224B may come in many sizes and shapes depending on the machine it serves. The coupling part 224A has slots 224C (FIG. 6C) that mate with plugs 224D on the coupling part 224B to provide electrical connection between the coupling parts. The electrical coupling structure 224 (which can be used with the with the electrical circuit connector described herein, or with other electrical connectors that plug into wall sockets) comprises the coupling parts 224A and 224B, and structure (described below) for releasably securing the coupling parts 224A and 224B to each other to provide an electrical connection between the coupling parts, and the structure for releasably securing the first and second coupling parts to each other comprises a device (schematically shown at 225 (FIGS. 6E and F that is configured to urge the coupling parts together and to provide a releasable lock that holds the coupling parts together and is releasable to enable the coupling parts to be separated, to break the electrical connection between the coupling parts.

The device 225 comprises at least one strap 225A that can slide in first and second directions in guide structure 225B located on the coupling part 224A. It is preferred that a plurality of straps 225A are provided, and in the illustrated embodiment 3 straps 225A and 3 guide structures 225B (each of which comprises a track 225C and an inverted U shaped member 225D) are provided, and each strap 225A can slide in a respective guide structure 225B. The straps 225A are made of flexible plastic (e.g. of the type used to form electrical ties), and are configured to interact with their respective guide structures 225B to apply a force that urges the coupling parts together and provides a releasable lock that holds the coupling parts 224A, 224B together when the straps slide in the first direction (e.g. toward the right in FIGS. 6B, 6C, 6E and 6F), and the strap and guide structures are configured to be manipulated in a manner that releases the look holding the coupling parts together and enables the straps to slide in the second direction (e.g. to the left in FIGS. 6B, 6C, 6E and 6F), to enable the coupling parts to be separated, to break the electrical connection between the coupling parts.

The straps 225A have pull tabs 229 at one end and tabs 228 with respective posts 227 and holes 226 at their other ends (FIG. 6B). The posts and holes enable the tabs to be connected to each other to form a yoke 233 (FIGS. 6E, 6F) about the electrical wires 234 at one end of the coupling part 224B and the guide structures 225B (each of which can comprises a track 225C, and an inverted U shaped member 225D which has locking, profiles on its inside configured to engage ratchet teeth 231 on a straps when the strap 225A slides in the first direction in the inverted U shaped members 225D. The straps 225A are biased toward the locking profiles on the insides of the U shaped members 225D such that the teeth 231 on the straps 225A ratchet against the locking profiles on the insides of the inverted U shaped members 225D when the straps slide in the guide structures in the first direction, and engage with and lock the straps against movement in the second direction when the straps have been moved to a selected amount in the inverted U shaped members 225D. The straps 225A and guide structures 225B can be manipulated to separate the ratchet teeth 231 of the straps 225A from the locking profiles on the insides of the inverted U shaped members 225D, to enable the straps to slide in the second direction. The yoke 233 formed at the one end of the coupling parts is configured such that when the straps slide in the first direction, the yoke 233 formed by the connection of the straps applies a force to the coupling parts that urges the coupling parts together. That force is applied, e.g. to the left side of the coupling in FIGS. 6*e*, 6*f* and urges the coupling parts 224A, 224B together.

Thus, by forming the yoke 233, and pulling the pull tabs 229 of the straps, the coupling parts 224A, 224B are urged together, to provide a secure electrical connection between the coupling parts. As the pull tabs 229 are being pulled, the straps 225A slide in the first direction along the tracks 225C and the insides of the inverted U shaped members 225D, and the straps are biased toward the insides of the inverted U shaped members 225D, so that the teeth 231 ratchet against the locking profiles on the inside of the inverted U shaped members 225D. When the straps have been pulled to a desired extent in the first direction, the ratchet teeth 231 can engage the locking profiles on the inside of the inverted U shaped members 225D, to resist movement of the straps in the second direction, thereby providing a secure coupling between the coupling parts 224A, 224B. When it is desired to release the coupling, the posts and holes 226, 227 used to form the yoke 233 can be disconnected, thereby disassembling the yoke 233, and allowing the flexible straps 225A be manipulated so that the ratchet teeth disengage from the inverted U shaped members 225D, so that the straps 225A can slide in the second direction to enable the coupling parts to be disconnected. Alternatively, the flexible straps 225A can be bent against their bias to disengage the ratchet teeth 231 from the guides 225B, allowing the flexible straps to move in the opposite direction to enable the coupling parts to be disengaged from each other.

Thus, the foregoing detailed description provides a new and useful electrical circuit connector, and new and useful coupling structure designed to avoid the types of traumas to electrical connections and circuits that can be associated with a patient support such as a hospital bed. With the foregoing disclosure in mind, it is believed that various adaptations of the electrical connector and/or electrical coupling, to prevent traumatic damage to circuits and connections in environments comparable to those found in a hospital bed setting, will be apparent to those in the art.

The invention claimed is:

1. An electrical connector for attachment to a wall outlet that is provided in a wall, comprising a cap formed of non conducting material, the cap having a perimeter, a first side configured to lie directly against the wall when the cap is attached to the wall outlet, the first side accommodating one or more electrical plug components configured to engage the wall outlet and connect the connector to the wall outlet and electrical conductors extending from the electrical plug components and along the first side of the cap and to the perimeter of the cap, and the cap having a second side having a substantially smooth, continuous surface extending from the perimeter of the cap over the entire extent of the cap and providing an insulating cover for the electrical plug components and a relatively smooth, continuous exterior surface for the cap when the electrical connector is attached to the wall outlet, so that electrical conducting portions of the connector are electrically insulated by the cap, extend along the outside of the cap to the perimeter of the cap, and the perimeter and relatively smooth, continuous surface of the cap providing an exterior of the cap that is relatively free of edges, ridges or other surface configurations that could be caught by an object rubbing against the cap that would cause the cap to pull away from the wall when the electrical connector is connected to the wall outlet.

2. The electrical connector of claim 1, wherein the cap has an electrically insulated transition portion at the perimeter, of the cap, that provides route for an insulated electrical circuit connection between the electrical conductors that extend to the perimeter of the cap and one or more electrical wires that extend beyond the perimeter of the cap to a coupling configured to mate with another connector for providing electrical connection to a device associated with the another connector.

3. The electrical connector of claim 2, wherein the relatively smooth, continuous surface has a curved configuration from the perimeter over the entire extent of the cap.

4. The electrical connector of claim 3, wherein the relatively smooth, continuous surface of the cap has a curved partial spherical configuration with a curvature that has a relatively constant radius.

5. The electrical connector of claim 2, wherein the electrical coupling structure comprises first and second coupling parts, and structure for releasably securing the first and second coupling parts to each other, the first and second coupling parts having respective mating portions that are coupled together to provide an electrical connection between the coupling parts, and the structure for releasably securing the first and second coupling parts to each other comprising a device that is configured to urge the coupling parts together and to provide a releasable lock that holds the coupling parts together and is releasable to enable the coupling parts to be separated, to break the electrical connection between the coupling parts.

6. The electrical connector of claim 5, wherein the device comprises at least one strap that can slide in first and second directions in guide structure located on the coupling parts, the strap configured to interact with the guide structure to apply a force that urges the coupling parts together and provides a releasable lock that holds the coupling parts together when the strap slides in the first direction, and the strap and guide structure configured to be manipulated in a manner that releases the lock holding the coupling parts together and enables the strap to slide in the second direction, to enable the coupling parts to be separated, to break the electrical connection between the coupling parts.

7. The electrical connector of claim 6, wherein the strap and the guide structure have mating locking teeth which are configured to engage each other when the strap slides in the first direction, and the strap and guide structure are biased toward positions such that they engage each other when the strap slides in the first direction, and wherein the strap and guide structure can be manipulated to separate from each other, to enable the strap to slide in the second direction.

8. The electrical connector of claim 7, wherein the device comprises a plurality of strap and guide structures of the type defined in claim 7.

9. The electrical connector of claim 8, wherein the straps are configured to engage each other and to provide a connection to one of the coupling parts such that when the straps slide in the first direction, the connection of the straps applies a force to the coupling parts that urges the coupling parts together.

10. An electrical connector for attachment to a wall outlet that is provided in a wall of a medical care facility and providing electrical power connection for a bed of the medical care facility or a device being used in the vicinity of the bed, comprising a cap formed of non conducting material, the cap having a relatively flat configuration with a perimeter, a first side configured to lie directly against the wall with the perimeter as close to the wall as possible when the cap is attached to a wall outlet, the first side accommodating one or more electrical plug components configured to engage sockets of the wall outlet and connect the connector to the wall outlet and electrical conductors extending from the electrical plug components and along the first side of the cap and to the perimeter of the cap, and the cap having a second side having a substantially smooth, continuous surface extending from the perimeter of the cap over the entire extent of the cap and providing an insulating cover for the electrical plug components and a relatively smooth, continuous exterior surface for the cap when the electrical connector is attached to the wall outlet, so that electrical conducting portions of the connector are electrically insulated by the cap, extend along the outside of the cap to the perimeter of the cap, and the perimeter and relatively smooth, continuous surface of the cap providing an exterior of the cap that is relatively free of edges, ridges or other surface configurations that could be caught by an object rubbing against the cap that would cause the cap to pull away from the wall when the electrical connector is connected to the wall outlet.

11. The electrical connector of claim 10, wherein the cap has an electrically insulated transition portion at the perimeter of the cap that provides an insulated electrical circuit connection between the electrical conductors that extend to the perimeter of the cap and electrical wires that extend beyond the perimeter of the cap to a coupling configured to mate with another a connector for providing electrical connection to a bed associated with the another connector.

12. The electrical connector of claim 11, wherein the relatively smooth, continuous surface has a curved configuration from the perimeter over the entire extent of the cap.

13. The electrical connector of claim 12, wherein the relatively smooth, continuous surface of the cap has a curved partial spherical configuration with a curvature that has a relatively constant radius.

* * * * *